US008992699B2

(12) United States Patent
Bain et al.

(10) Patent No.: US 8,992,699 B2
(45) **Date of Patent: *Mar. 31, 2015**

(54) NICKEL-BASE SUPERALLOYS AND COMPONENTS FORMED THEREOF

(75) Inventors: Kenneth Rees Bain, Loveland, OH (US); David Paul Mourer, Beverly, MA (US); Richard DiDomizio, Scotia, NY (US); Timothy Hanlon, Glenmont, NY (US); Laurent Cretegny, Niskayuna, NY (US); Andrew Ezekiel Wessman, Walton, KY (US)

(73) Assignee: General Electric Company, Schenectady, NY (US)

( * ) Notice: Subject to any disclaimer, the term of this patent is extended or adjusted under 35 U.S.C. 154(b) by 1012 days.

This patent is subject to a terminal disclaimer.

(21) Appl. No.: 12/474,580

(22) Filed: May 29, 2009

(65) Prior Publication Data

US 2010/0303665 A1 Dec. 2, 2010

(51) Int. Cl.

| | |
|---|---|
| ***C22C 19/05*** | (2006.01) |
| ***C22C 30/00*** | (2006.01) |
| ***C22C 1/04*** | (2006.01) |
| ***C22F 1/10*** | (2006.01) |

(52) U.S. Cl.

CPC ..... *C22C 19/056* (2013.01); *C22C 1/0433* (2013.01); *C22F 1/10* (2013.01); *B22F 2998/00* (2013.01)

USPC ..... 148/428; 420/448

(58) Field of Classification Search

USPC ..... 420/448; 148/428

See application file for complete search history.

(56) References Cited

U.S. PATENT DOCUMENTS

| | | | | |
|---|---|---|---|---|
| 3,576,681 | A | | 4/1971 | Barker et al. |
| 3,655,458 | A | * | 4/1972 | Reichman ..... 419/15 |
| 3,748,192 | A | | 7/1973 | Boesch |
| 3,890,816 | A | | 6/1975 | Allen et al. |
| 4,121,950 | A | | 10/1978 | Guimier et al. |
| 4,207,098 | A | | 6/1980 | Shaw |
| 4,388,124 | A | | 6/1983 | Henry |
| 4,685,977 | A | | 8/1987 | Chang |
| 4,769,087 | A | * | 9/1988 | Genereux et al. ..... 148/677 |
| 4,814,023 | A | | 3/1989 | Chang |
| 4,820,353 | A | | 4/1989 | Chang |
| 4,867,812 | A | | 9/1989 | Henry |
| 4,888,064 | A | | 12/1989 | Chang |
| 4,894,089 | A | | 1/1990 | Henry |
| 4,957,567 | A | | 9/1990 | Krueger et al. |
| 4,981,644 | A | | 1/1991 | Chang |
| 4,983,233 | A | | 1/1991 | Henry |
| 5,037,495 | A | | 8/1991 | Henry |
| 5,055,147 | A | | 10/1991 | Henry |
| 5,061,324 | A | | 10/1991 | Chang |
| 5,080,734 | A | | 1/1992 | Krueger et al. |
| 5,087,305 | A | | 2/1992 | Chang |
| 5,104,614 | A | | 4/1992 | Ducrocq et al. |
| 5,124,123 | A | | 6/1992 | Henry |
| 5,129,968 | A | | 7/1992 | Henry |
| 5,129,969 | A | | 7/1992 | Henry |
| 5,129,970 | A | | 7/1992 | Henry |
| 5,129,971 | A | | 7/1992 | Henry |
| 5,130,086 | A | | 7/1992 | Henry |
| 5,130,087 | A | | 7/1992 | Henry |
| 5,130,088 | A | | 7/1992 | Henry |
| 5,130,089 | A | | 7/1992 | Henry |
| 5,143,563 | A | | 9/1992 | Krueger et al. |
| 5,156,808 | A | | 10/1992 | Henry |
| 5,171,380 | A | | 12/1992 | Henry |
| 5,393,483 | A | | 2/1995 | Chang |
| 5,476,555 | A | | 12/1995 | Erickson |
| 5,662,749 | A | | 9/1997 | Chang |
| 5,891,272 | A | | 4/1999 | Raymond et al. |
| 5,897,718 | A | | 4/1999 | Hessell et al. |
| 6,132,527 | A | | 10/2000 | Hessell et al. |
| 6,468,368 | B1 | | 10/2002 | Merrick et al. |
| 6,521,175 | B1 | | 2/2003 | Mourer et al. |
| 6,866,727 | B1 | | 3/2005 | Hieber et al. |
| 6,890,370 | B2 | | 5/2005 | Merrick et al. |
| 6,969,431 | B2 | | 11/2005 | Hieber et al. |
| 6,974,508 | B1 | | 12/2005 | Gabb et al. |
| 7,208,116 | B2 | | 4/2007 | Manning et al. |
| 2005/0142023 | A1 | * | 6/2005 | Voice et al. ..... 419/38 |
| 2007/0160476 | A1 | | 7/2007 | Cheng et al. |
| 2010/0303665 | A1 | | 12/2010 | Bain et al. |
| 2011/0203707 | A1 | | 8/2011 | Mourer et al. |

FOREIGN PATENT DOCUMENTS

| | | |
|---|---|---|
| EP | 0248757 B1 | 3/1990 |
| EP | 0924309 A2 | 6/1999 |
| EP | 1195446 | 10/2002 |
| EP | 1710322 | 11/2006 |

OTHER PUBLICATIONS

ASM International, Materials Park, Ohio, ASM Specialty Handbook: Nickel, Cobalt, and Their Alloys, "Metallography and Microstructures of Heat Resistant Alloys", Dec. 2000, pp. 302-304.*
EP 10163817.9, Search Report and Written Opinion, Aug. 27, 2010.
EP 10163821.1, Search Report and Written Opinion, Aug. 30, 2010.
Non-Final Rejection towards corresponding U.S. Appl. No. 12/474,651 dated Jun. 23, 2014.
PCT Search Report and Written Opinion issued in connection with corresponding Application No. PCT/US2014/017336 on Nov. 11, 2014.

* cited by examiner

*Primary Examiner* — Jessee Roe
(74) *Attorney, Agent, or Firm* — General Electric Company; Brian P. Overbeck

(57) ABSTRACT

A gamma prime nickel-base superalloy and components formed therefrom that exhibit improved high-temperature dwell capabilities, including creep and hold time fatigue crack growth behavior. A particular example of a component is a powder metallurgy turbine disk of a gas turbine engine. The gamma-prime nickel-base superalloy contains, by weight, 16.0 to 30.0% cobalt, 11.5 to 15.0% chromium, 4.0 to 6.0% tantalum, 2.0 to 4.0% aluminum, 1.5 to 6.0% titanium, up to 5.0% tungsten, 1.0 to 7.0% molybdenum, up to 3.5% niobium, up to 1.0% hafnium, 0.02 to 0.20% carbon, 0.01 to 0.05% boron, 0.02 to 0.10% zirconium, the balance essentially nickel and impurities, wherein the titanium:aluminum weight ratio is 0.5 to 2.0.

21 Claims, 8 Drawing Sheets

| | Al | B | C | Co | Cr | Hf | Mo | Nb | Ta | Ti | W | Zr | Ni | Y |
|---|---|---|---|---|---|---|---|---|---|---|---|---|---|---|
| ME41 | 2.4 | 0.03 | 0.05 | 20.0 | 13.0 | 0.4 | 4.5 | 1.0 | 5.0 | 3.6 | 1.5 | 0.05 | 48.5 | 0.0 |
| ME42 | 2.4 | 0.03 | 0.05 | 20.0 | 13.0 | 0.4 | 1.5 | 1.0 | 5.0 | 3.6 | 4.5 | 0.05 | 48.5 | 0.0 |
| ME43 | 3.0 | 0.03 | 0.05 | 20.0 | 13.0 | 0.4 | 4.5 | 1.0 | 5.0 | 4.5 | 1.5 | 0.05 | 47.0 | 0.0 |
| ME44 | 3.0 | 0.03 | 0.05 | 20.0 | 13.0 | 0.4 | 1.5 | 1.0 | 5.0 | 4.5 | 4.5 | 0.05 | 47.0 | 0.0 |
| ME49 | 3.2 | 0.03 | 0.05 | 20.0 | 13.0 | 0.4 | 2.9 | 1.5 | 5.0 | 3.2 | 3.0 | 0.05 | 47.7 | 0.0 |
| ME45 | 3.6 | 0.03 | 0.05 | 20.0 | 13.0 | 0.4 | 4.5 | 1.5 | 5.0 | 1.8 | 1.5 | 0.05 | 48.6 | 0.0 |
| ME46 | 3.6 | 0.03 | 0.05 | 20.0 | 13.0 | 0.4 | 1.5 | 1.5 | 5.0 | 1.8 | 4.5 | 0.05 | 48.6 | 0.0 |
| ME47 | 4.4 | 0.03 | 0.05 | 20.0 | 13.0 | 0.4 | 4.5 | 1.5 | 5.0 | 2.2 | 1.5 | 0.05 | 47.4 | 0.0 |
| ME48 | 4.4 | 0.03 | 0.05 | 20.0 | 13.0 | 0.4 | 1.5 | 1.5 | 5.0 | 2.2 | 4.5 | 0.05 | 47.4 | 0.0 |
| R88DT | 2.125 | 0.016 | 0.053 | 13.000 | 16.000 | 0.000 | 4.000 | 0.700 | 0.000 | 3.725 | 4.000 | 0.045 | 56.337 | 0.000 |
| ME491 | 3.6 | 0.03 | 0.05 | 18.0 | 10.5 | 0.4 | 2.9 | 1.5 | 2.5 | 3.6 | 3.0 | 0.05 | 53.9 | 0.0 |
| ME492 | 3.0 | 0.03 | 0.05 | 22.0 | 14.0 | 0.4 | 2.9 | 1.5 | 7.5 | 3.0 | 3.0 | 0.05 | 42.6 | 0.0 |

FIG. 2

| | UTS | YS | EL | RA | CREEP | HTFCGR | FCGR | GAMMA' % | SOLVUS |
|---|---|---|---|---|---|---|---|---|---|
| **ME41** | 217 | 151 | 13.4 | 16.2 | 2782 | 4.39E-08 | 1.49E-05 | 49 | 2132 |
| **ME42** | 210 | 168 | 11.0 | 14.1 | 24508 | 4.39E-08 | 1.08E-05 | 50 | 2132 |
| **ME43** | 218 | 162 | 12.0 | 15.2 | 9152 | 2.10E-08 | 1.97E-05 | 57 | 2173 |
| **ME44** | 211 | 179 | 9.7 | 13.1 | 80631 | 2.10E-08 | 1.43E-05 | 57 | 2173 |
| **ME49** | 213 | 166 | 11.9 | 14.8 | 12700 | 8.66E-08 | 1.82E-05 | 54 | 2145 |
| **ME45** | 213 | 148 | 15.2 | 17.5 | 1331 | 2.74E-07 | 2.60E-05 | 50 | 2115 |
| **ME46** | 206 | 166 | 12.8 | 15.4 | 11725 | 2.74E-07 | 1.89E-05 | 51 | 2115 |
| **ME47** | 211 | 156 | 14.6 | 17.0 | 2971 | 1.97E-07 | 3.77E-05 | 57 | 2147 |
| **ME48** | 205 | 174 | 12.2 | 14.9 | 26176 | 1.97E-07 | 2.75E-05 | 57 | 2147 |
| R88DT | 211 | 148 | 18.0 | 19.9 | 1992 | 8.31E-06 | 8.47E-06 | 41 | 2063 |
| **ME491** | 211 | 151 | 14.4 | 16.9 | 4255 | 1.57E-05 | 2.20E-05 | 54 | 2162 |
| **ME492** | 216 | 179 | 9.0 | 12.5 | 51109 | 2.63E-09 | 1.66E-05 | 56 | 2152 |

FIG. 3

| | Al | B | C | Co | Cr | Hf | Mo | Nb | Ta | Ti | W | Zr | Ni | Y |
|---|---|---|---|---|---|---|---|---|---|---|---|---|---|---|
| HL-06 | 2.40 | 0.03 | 0.05 | 20.00 | 13.00 | 0.40 | 4.50 | 1.00 | 4.80 | 3.60 | 1.50 | 0.05 | 48.67 | 0.0 |
| HL-07 | 2.40 | 0.03 | 0.05 | 20.00 | 13.00 | 0.40 | 1.50 | 1.00 | 4.80 | 3.60 | 4.50 | 0.05 | 48.67 | 0.0 |
| HL-08 | 3.00 | 0.03 | 0.05 | 18.00 | 12.00 | 0.40 | 1.50 | 1.00 | 4.80 | 4.50 | 4.50 | 0.05 | 50.17 | 0.0 |
| HL-09 | 3.60 | 0.03 | 0.05 | 20.00 | 13.00 | 0.40 | 1.50 | 1.50 | 4.80 | 1.80 | 4.50 | 0.05 | 48.77 | 0.0 |
| HL-10 | 3.20 | 0.03 | 0.05 | 18.00 | 12.00 | 0.40 | 2.90 | 1.50 | 4.80 | 3.20 | 3.00 | 0.05 | 50.87 | 0.0 |
| HL-11 | 3.33 | 0.030 | 0.050 | 19.72 | 12.44 | 0.400 | 3.63 | 1.02 | 7.81 | 1.86 | 2.05 | 0.050 | 47.61 | 0.0 |
| HL-12 | 3.88 | 0.030 | 0.050 | 12.53 | 9.64 | 0.400 | 3.86 | 1.94 | 9.12 | 2.20 | 0.00 | 0.050 | 56.30 | 0.0 |
| HL-13 | 3.00 | 0.030 | 0.050 | 12.42 | 9.55 | 0.400 | 3.82 | 1.88 | 8.04 | 1.36 | 3.84 | 0.050 | 55.56 | 0.0 |
| HL-14 | 3.11 | 0.030 | 0.050 | 10.75 | 11.55 | 0.400 | 2.30 | 0.96 | 9.69 | 1.72 | 2.81 | 0.050 | 56.58 | 0.0 |
| HL-15 | 3.21 | 0.030 | 0.050 | 20.29 | 12.56 | 0.400 | 6.61 | 1.12 | 3.30 | 3.52 | 0.00 | 0.050 | 48.86 | 0.0 |

FIG. 5

| | UTS | YS | EL | RA | CREEP | HTFCGR | FCGR | GAMMA' % | SOLVUS |
|---|---|---|---|---|---|---|---|---|---|
| HL-06 | 217 | 150 | 13.6 | 16.4 | **2536** | 5.33E-08 | 1.49E-05 | 49 | 2129 |
| HL-07 | 210 | 168 | 11.2 | 14.3 | **22341** | 5.33E-08 | 1.08E-05 | 49 | 2129 |
| HL-08 | 209 | 172 | 9.9 | 13.3 | **43082** | 8.84E-08 | 1.43E-05 | 57 | 2187 |
| HL-09 | 206 | 165 | 13.0 | 15.6 | **10688** | 3.32E-07 | 1.89E-05 | 50 | 2112 |
| HL-10 | 211 | 159 | 12.1 | 15.0 | **6786** | 3.65E-07 | 1.82E-05 | 53 | 2159 |
| HL-11 | 207 | 156 | 12.0 | 14.9 | **4199** | 2.49E-08 | 2.09E-05 | 52 | 2149 |
| HL-12 | 201 | 143 | 9.8 | 13.2 | **1008** | 3.31E-07 | 2.77E-05 | 59 | 2251 |
| HL-13 | 209 | 149 | 9.5 | 12.7 | **2557** | 2.01E-06 | 1.83E-05 | 51 | 2191 |
| HL-14 | 193 | 147 | 9.3 | 12.7 | **1174** | 1.32E-08 | 1.64E-05 | 52 | 2209 |
| HL-15 | 222 | 139 | 16.6 | 18.9 | **713** | 4.55E-07 | 2.71E-05 | 52 | 2131 |

FIG. 6

| | Ni | Al | B | C | Co | Cr | Mo | Nb | Ta | Ti | W | Hf | Zr |
|---|---|---|---|---|---|---|---|---|---|---|---|---|---|
| Alloy A | 49.0 | 2.4 | 0.031 | 0.065 | 19.7 | 13.2 | 4.4 | 1.0 | 5.0 | 3.4 | 1.4 | 0.25 | 0.049 |
| Alloy B | 49.0 | 2.4 | 0.030 | 0.048 | 19.9 | 13.3 | 1.4 | 1.0 | 4.9 | 3.5 | 4.3 | 0.31 | 0.048 |
| Alloy C | 50.5 | 2.8 | 0.030 | 0.051 | 18.0 | 12.3 | 1.5 | 1.0 | 4.9 | 4.3 | 4.2 | 0.34 | 0.048 |
| Alloy D | 48.9 | 3.4 | 0.030 | 0.061 | 19.5 | 13.6 | 1.6 | 1.0 | 4.9 | 1.8 | 4.6 | 0.42 | 0.049 |
| Alloy E | 50.8 | 3.2 | 0.026 | 0.052 | 18.0 | 12.1 | 2.9 | 1.4 | 5.1 | 3.1 | 2.8 | 0.39 | 0.054 |
| Alloy F | 47.5 | 3.2 | 0.033 | 0.054 | 19.7 | 12.8 | 3.5 | 1.0 | 7.8 | 1.7 | 2.1 | 0.40 | 0.055 |
| Alloy G | 56.7 | 3.6 | 0.030 | 0.063 | 12.6 | 10.5 | 3.8 | 1.8 | 9.1 | 1.4 | 0 | 0.45 | 0.056 |
| Alloy H | 55.9 | 2.9 | 0.026 | 0.050 | 12.7 | 10.1 | 3.7 | 1.8 | 8.0 | 1.4 | 3.0 | 0.43 | 0.046 |
| Alloy I | 49.2 | 3.1 | 0.028 | 0.073 | 20.0 | 12.7 | 6.5 | 1.1 | 3.6 | 3.3 | 0 | 0.33 | 0.061 |

FIG. 8

| Alloy | 0.02% YS | 0.2% YS | UTS | RA | EL | 0.2% Creep | Rupture Time |
|---|---|---|---|---|---|---|---|
| A | 124 | 147 | 172 | 18 | 25 | 5.1 | 72.3 |
| B | 127 | 150 | 174 | 11 | 15 | 2.3 | 30.3 |
| C | | | | | | | |
| D | 122 | 139 | 160 | 12 | 16 | 1.6 | 25.1 |
| E | 136 | 152 | 173 | 16 | 20 | 9.5 | 105.4 |
| F | 125 | 139 | 160 | 14 | 19 | 1.8 | 34.4 |
| G | | | | | | | |
| H | 137 | 152 | 177 | 6 | 8.5 | 4.2 | 65.5 |
| I | 127 | 143 | 167 | 18 | 24 | 5.3 | 111.3 |
| R104 | 127 | 142 | 168 | 21 | 22 | 3.6 | 44.0 |

FIG. 9

NICKEL-BASE SUPERALLOYS AND COMPONENTS FORMED THEREOF

BACKGROUND OF THE INVENTION

The present invention generally relates to nickel-base alloy compositions, and more particularly to nickel-base superalloys suitable for components requiring a polycrystalline microstructure and high temperature dwell capability, for example, turbine disks of gas turbine engines.

The turbine section of a gas turbine engine is located downstream of a combustor section and contains a rotor shaft and one or more turbine stages, each having a turbine disk (rotor) mounted or otherwise carried by the shaft and turbine blades mounted to and radially extending from the periphery of the disk. Components within the combustor and turbine sections are often formed of superalloy materials in order to achieve acceptable mechanical properties while at elevated temperatures resulting from the hot combustion gases. Higher compressor exit temperatures in modem high pressure ratio gas turbine engines can also necessitate the use of high performance nickel superalloys for compressor disks, blisks, and other components. Suitable alloy compositions and microstructures for a given component are dependent on the particular temperatures, stresses, and other conditions to which the component is subjected. For example, airfoil components such as blades and vanes are often formed of equiaxed, directionally solidified (DS), or single crystal (SX) superalloys, whereas turbine disks are typically formed of superalloys that must undergo carefully controlled forging, heat treatments, and surface treatments such as peening to produce a polycrystalline microstructure having a controlled grain structure and desirable mechanical properties.

Turbine disks are often formed of gamma prime (γ') precipitation-strengthened nickel-base superalloys (hereinafter, gamma prime nickel-base superalloys) containing chromium, tungsten, molybdenum, rhenium and/or cobalt as principal elements that combine with nickel to form the gamma (γ) matrix, and contain aluminum, titanium, tantalum, niobium, and/or vanadium as principal elements that combine with nickel to form the desirable gamma prime precipitate strengthening phase, principally $Ni_3(Al,Ti)$. Particularly notable gamma prime nickel-base superalloys include René 88DT (R88DT; U.S. Pat. No. 4,957,567) and René 104 (R104; U.S. Pat. No. 6,521,175), as well as certain nickel-base superalloys commercially available under the trademarks Inconel®, Nimonic®, and Udimet®. R88DT has a composition of, by weight, about 15.0-17.0% chromium, about 12.0-14.0% cobalt, about 3.5-4.5% molybdenum, about 3.5-4.5% tungsten, about 1.5-2.5% aluminum, about 3.2-4.2% titanium, about 0.5.0-1.0% niobium, about 0.010-0.060% carbon, about 0.010-0.060% zirconium, about 0.010-0.040% boron, about 0.0-0.3% hafnium, about 0.0-0.01 vanadium, and about 0.0-0.01 yttrium, the balance nickel and incidental impurities. R104 has a nominal composition of, by weight, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, about 0.0-2.5% rhenium, about 0.02-0.10% carbon, about 0.02-0.10% boron, about 0.03-0.10% zirconium, the balance nickel and incidental impurities.

Disks and other critical gas turbine engine components are often forged from billets produced by powder metallurgy (P/M), conventional cast and wrought processing, and spraycast or nucleated casting forming techniques. Gamma prime nickel-base superalloys formed by powder metallurgy are particularly capable of providing a good balance of creep, tensile, and fatigue crack growth properties to meet the performance requirements of turbine disks and certain other gas turbine engine components. In a typical powder metallurgy process, a powder ofthe desired superalloy undergoes consolidation, such as by hot isostatic pressing (HIP) and/or extrusion consolidation. The resulting billet is then isothermally forged at temperatures slightly below the gamma prime solvus temperature of the alloy to approach superplastic forming conditions, which allows the filling ofthe die cavity through the accumulation of high geometric strains without the accumulation of significant metallurgical strains. These processing steps are designed to retain the fine grain size originally within the billet (for example, ASTM 10 to 13 or finer), achieve high plasticity to fill near-net-shape forging dies, avoid fracture during forging, and maintain relatively low forging and die stresses. In order to improve fatigue crack growth resistance and mechanical properties at elevated temperatures, these alloys are then heat treated above their gamma prime solvus temperature (generally referred to as supersolvus heat treatment) to cause significant, uniform coarsening of the grains.

Though alloys such as R88DT and R104 have provided significant advances in high temperature capabilities of superalloys, further improvements are continuously being sought. For example, high temperature dwell capability has emerged as an important factor for the high temperatures and stresses associated with more advanced military and commercial engine applications. As higher temperatures and more advanced engines are developed, creep and crack growth characteristics of current alloys tend to fall short of the required capability to meet mission/life targets and requirements of advanced disk applications. It has become apparent that a particular aspect of meeting this challenge is to develop compositions that exhibit desired and balanced improvements in creep and hold time (dwell) fatigue crack growth rate characteristics at temperatures of 1200° F. (about 650° C.) and higher, while also having good producibility and thermal stability. However, complicating this challenge is the fact that creep and crack growth characteristics are difficult to improve simultaneously, and can be significantly influenced by the presence or absence of certain alloying constituents as well as relatively small changes in the levels of the alloying constituents present in a superalloy.

BRIEF DESCRIPTION OF THE INVENTION

The present invention provides a gamma prime nickel-base superalloy and components formed therefrom that exhibit improved high-temperature dwell capabilities, including creep and hold time fatigue crack growth behavior.

According to a first aspect of the invention, the gamma-prime nickel-base superalloy contains, by weight, 16.0 to 30.0% cobalt, 11.5 to 15.0% chromium, 4.0 to 6.0% tantalum, 2.0 to 4.0% aluminum, 1.5 to 6.0% titanium, 1.0 to 5.0% tungsten, 1.0 to 5.0% molybdenum, up to 3.5% niobium, up to 1.0% hafnium, 0.02 to 0.20% carbon, 0.01 to 0.05% boron, 0.02 to 0.10% zirconium, the balance essentially nickel and impurities, wherein the titanium:aluminum weight ratio is 0.5 to 2.0.

Another aspect of the invention are components that can be formed from the alloy described above, particular examples of which include turbine disks and compressor disks and blisks of gas turbine engines.

A significant advantage of the invention is that the nickel-base superalloy described above provides the potential for balanced improvements in high temperature dwell properties, including improvements in both creep and hold time fatigue crack growth rate (HTFCGR) characteristics at temperatures of 1200° F. (about 650° C.) and higher, while also having good producibility and good thermal stability. Improvements in other properties are also believed possible, particularly if appropriately processed using powder metallurgy, hot working, and heat treatment techniques.

Other aspects and advantages of this invention will be better appreciated from the following detailed description.

BRIEF DESCRIPTION OF THE DRAWINGS

FIG. 2 is a table listing a first series of nickel-base superalloy compositions identified by the present invention as potential compositions for use as a turbine disk alloy.

FIG. 3 is a table compiling various predicted properties for the nickel-base superalloy compositions of FIG. 2.

FIG. 5 is a table listing a second series of nickel-base superalloy compositions identified by the present invention as potential compositions for use as a turbine disk alloy.

FIG. 6 is a table compiling various predicted properties for the nickel-base superalloy compositions of FIG. 5.

FIG. 8 is a table listing a third series of nickel-base superalloy compositions identified by the present invention as potential compositions for use as a turbine disk alloy.

FIG. 9 is a table compiling various properties determined for the nickel-base superalloy compositions of FIG. 8.

DETAILED DESCRIPTION OF THE INVENTION

Figure 1:
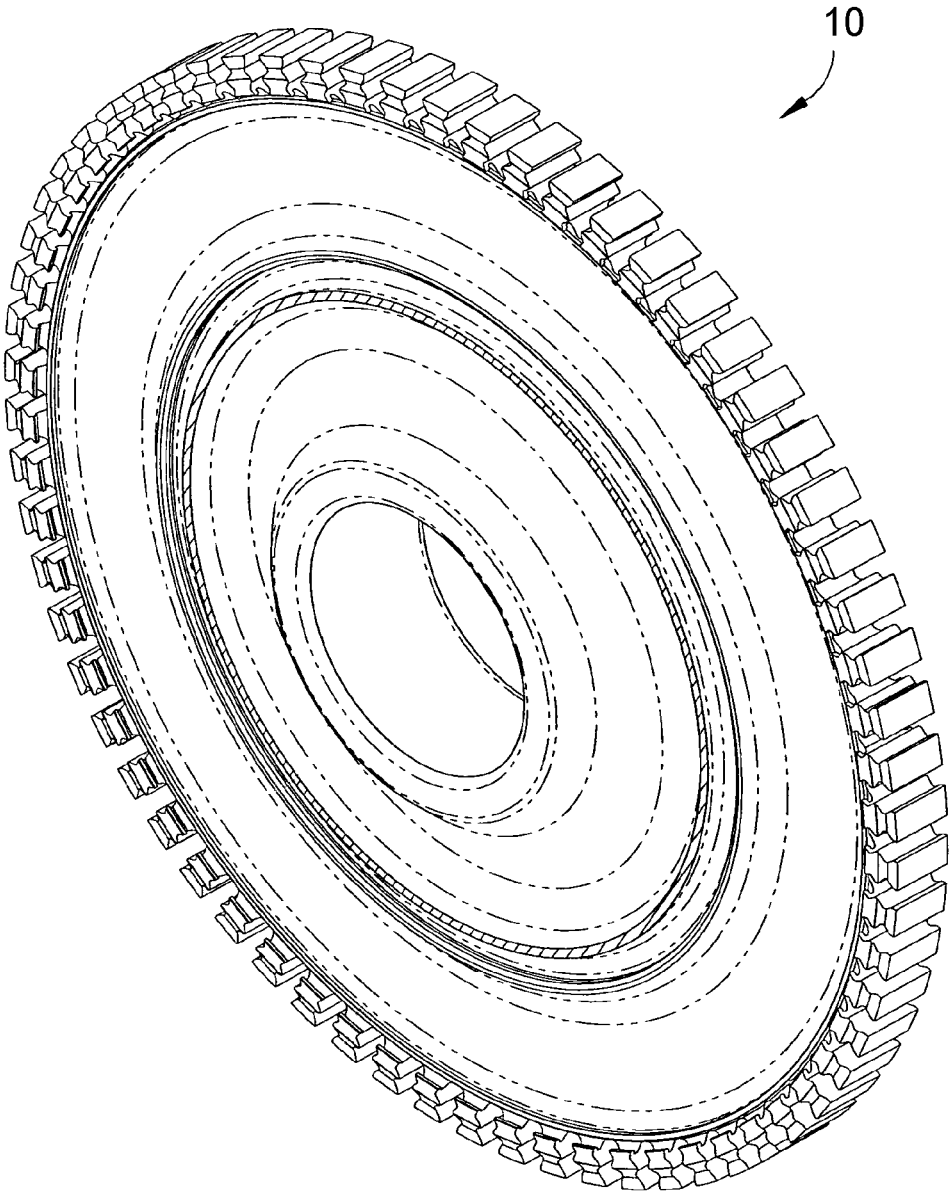
FIG. 1 is a perspective view of a turbine disk of a type used in gas turbine engines.

The present invention is directed to gamma prime nickel-base superalloys, and particular those suitable for components produced by a hot working (e.g., forging) operation to have a polycrystalline microstructure. A particular example represented in FIG. 1 is a high pressure turbine disk 10 for a gas turbine engine. The invention will be discussed in reference to processing of a high-pressure turbine disk for a gas turbine engine, though those skilled in the art will appreciate that the teachings and benefits of this invention are also applicable to compressor disks and blisks of gas turbine engines, as well as numerous other components that are subjected to stresses at high temperatures and therefore require a high temperature dwell capability.

Disks of the type shown in FIG. 1 are typically produced by isothermally forging a fine-grained billet formed by powder metallurgy (PM), a cast and wrought processing, or a spraycast or nucleated casting type technique. In a preferred embodiment utilizing a powder metallurgy process, the billet can be formed by consolidating a superalloy powder, such as by hot isostatic pressing (HIP) or extrusion consolidation. The billet is typically forged at a temperature at or near the recrystallization temperature of the alloy but less than the gamma prime solvus temperature of the alloy, and under superplastic forming conditions. After forging, a supersolvus (solution) heat treatment is performed, during which grain growth occurs. The supersolvus heat treatment is performed at a temperature above the gamma prime solvus temperature (but below the incipient melting temperature) of the superalloy to recrystallize the worked grain structure and dissolve (solution) the gamma prime precipitates in the superalloy. Following the supersolvus heat treatment, the component is cooled at an appropriate rate to re-precipitate gamma prime within the gamma matrix or at grain boundaries, so as to achieve the particular mechanical properties desired. The component may also undergo aging using known techniques.

Superalloy compositions of this invention were developed through the use of a proprietary analytical prediction process directed at identifying alloying constituents and levels capable of exhibiting better high temperature dwell capabilities than existing nickel-base superalloys. More particularly, the analysis and predictions made use of proprietary research involving the definition of elemental transfer functions for tensile, creep, hold time (dwell) crack growth rate, density, and other important or desired mechanical properties for turbine disks produced in the manner described above. Through simultaneously solving of these transfer functions, evaluations of compositions were performed to identify those compositions that appear to have the desired mechanical property characteristics for meeting advanced turbine engine needs, including creep and hold time fatigue crack growth rate (HTFCGR). The analytical investigations also made use of commercially-available software packages along with proprietary databases to predict phase volume fractions based on composition, allowing for the further definition of compositions that approach or in some cases slightly exceed undesirable equilibrium phase stability boundaries. Finally, solution temperatures and preferred amounts of gamma prime and carbides were defined to identify compositions with desirable combinations of mechanical properties, phase compositions and gamma prime volume fractions, while avoiding undesirable phases that could reduce in-service capability if equilibrium phases sufficiently form due to in-service environment characteristics. In the investigations, regression equations or transfer functions were developed based on selected data obtained from historical disk alloy development work. The investigations also relied on qualitative and quantitative data of the aforementioned nickel-base superalloys R88DT and R104.

Particular criteria utilized to identify potential alloy compositions included the desire for a volume percentage of gamma prime ($(Ni,Co)_3(Al, Ti, Nb, Ta)$) greater than that of R88DT, with the intent to promote strength at temperatures of 1400° F. (about 760° C.) and higher over extended periods of time. A gamma prime solvus temperature of not more than 2200° F. (about 1200° C.) was also identified as desirable for ease of manufacture during heat treatment and quench. In addition, certain compositional parameters were identified as starting points for the compositions, including the inclusion of hafnium for high temperature strength, chromium levels of 10 weight percent or more for corrosion resistance, aluminum levels greater than the nominal R88DT level to maintain gamma prime ($Ni_3(Al, Ti, Nb, Ta)$) stability, and cobalt levels of greater than 18 weight percent to aid in minimizing stacking fault energy (desirable for good cyclic behavior) and controlling the gamma prime solvus temperature. The regression equations and prior experience further indicated that relatively high levels of refractory elements were desirable to improve high temperature properties, and selective balancing of titanium, tungsten, niobium and molybdenum levels were employed to optimize creep and hold time fatigue crack growth behavior. Finally, regression factors relating to specific mechanical properties were utilized to narrowly identify potential alloy compositions that might be capable of exhibiting superior high temperature hold time (dwell) behavior, and would not be otherwise identifiable without extensive experimentation with a very large number of alloys. Such properties included ultimate tensile strength (UTS) at 1200° F. (about 650° C.), yield strength (YS), elongation (EL), reduction of area (RA), creep (time to 0.2% creep at 1200° F. and 115 ksi (about 650° C. at about 790 MPa), hold time (dwell) fatigue crack growth rate (HTFCGR; da/dt) at 1300° F. (about 700° C.) and a maximum stress intensity of 25 ksi√m (about 27.5 MPa√m), fatigue crack growth rate (FCGR), gamma prime volume percent (GAMMA' %) and gamma prime solvus temperature (SOLVUS), all of which were evaluated on a regression basis. Units for these properties reported herein are ksi for UTS and YS, percent for EL, RA and gamma prime volume percent, hours for creep, in/sec for crack growth rates (HTFCGR and FCGR), and ° F. for gamma prime solvus temperature. Thermodynamic calculations were also performed to assess alloy characteristics such as phase volume fraction, stability and solvii for gamma prime, carbides, borides and topologically close packed (TCP) phases.

Figure 4:
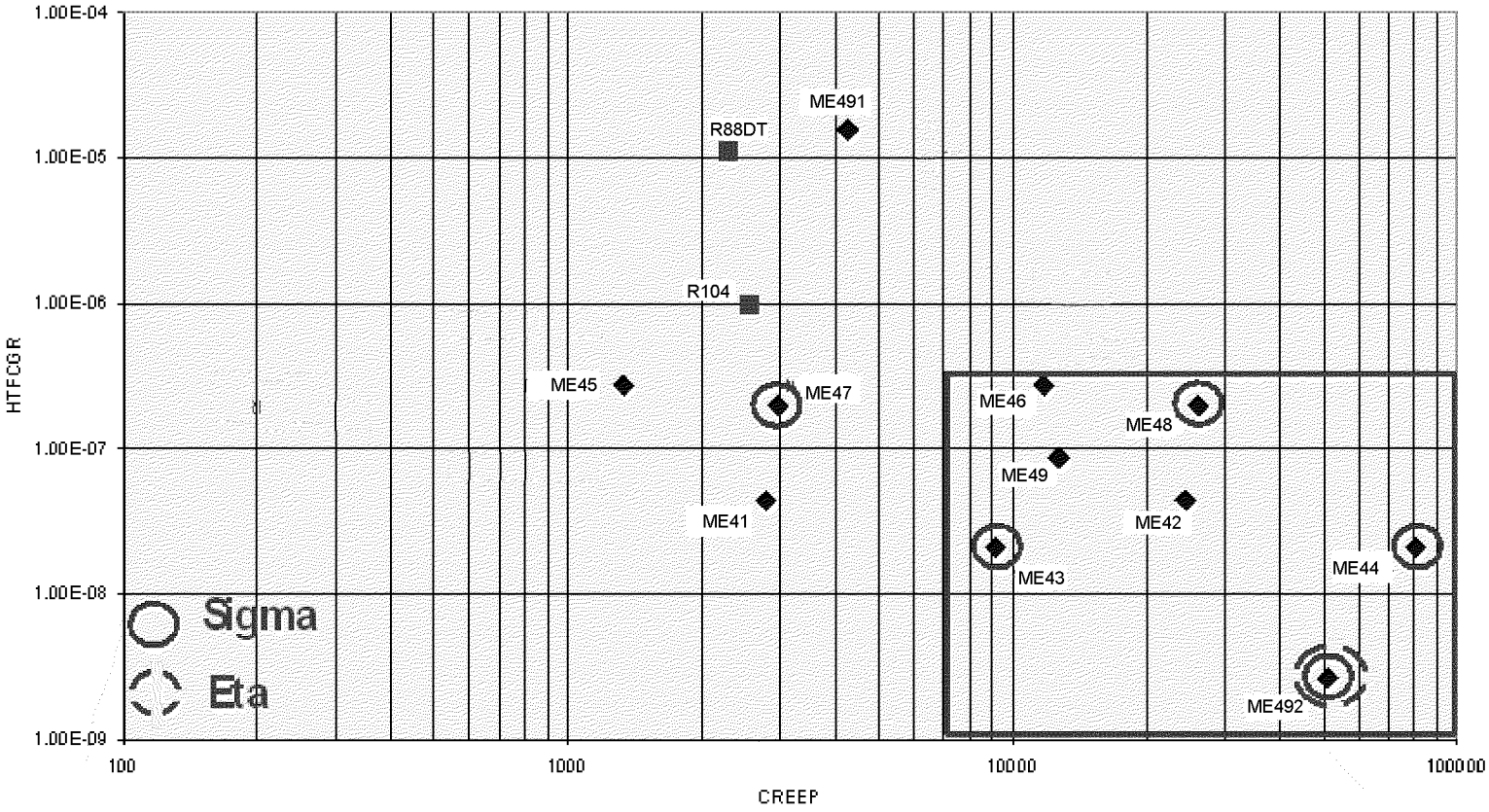
FIG. 4 is a graph plotting creep and hold time fatigue crack growth rate from the data of FIG. 3.

The process described above was performed iteratively utilizing expert opinion and guidance to define preferred compositions for manufacture and evaluation. From this process, a first series of alloy compositions were defined (by weight percent) as set forth in the table of FIG. 2. Also included in the table is R88DT for reference. Regression-based property predictions for the alloys of FIG. 2 are contained in the table of FIG. 3, and FIG. 4 contains a graph of the hold time fatigue crack growth rate (HTFCGR) and creep data from FIG. 3. From the visual depiction of FIG. 4, it can be seen that alloys ME42, ME43, ME44, ME46, ME48, ME49, and ME492 were analytically predicted to exhibit the best combinations of creep and hold time crack growth rate characteristics, with creep exceeding 7000 hours and HTFCGR of about $1\times10^{-7}$ in/s (about $1\times10^{-6}$ mm/s) or less, and therefore offering a notable improvement of the regression-based predictions for R88DT, R104, and other current alloys plotted in FIG. 4. Those alloys predicted to have improved dwell fatigue and creep over Rene 88DT were further evaluated by thermodynamic calculations to assess alloy characteristics such as phase volume fraction, stability, and solvii. From this analysis, it was predicted that Alloys ME43, ME44, ME48 and ME492 might be prone to potentially undesirable levels of detrimental topologically close-packed (TCP) phases, such as sigma phase (generally (Fe, Mo)x(Ni,Co)y, where x and y=1 to 7) and/or eta phase ($Ni_3Ti$).

Although the thermodynamic calculations of TCP phases were believed to have some uncertainty, the desire to avoid undesirable levels of formation of TCP phases provided the basis for defining a second series of alloy compositions, designated as alloys HL-06 through HL-15, whose compositions (in weight percent) are summarized in the table of FIG. 5. The second series included a designed experiment-based series of alloys (HL-06, -07, -08, -09 and -10) and a more exploratory-based series of alloys (HL-11, -12, -13, -14 and -15). The designed experiment-based series was largely based on the goal of providing a relatively high tantalum content while balancing Ti/Al and Mo/W+Mo ratios. Four of the five exploratory alloys were formulated to investigate the effect of high tantalum levels, while the fifth (HL-15) was formulated to have a lower tantalum level but a much higher molybdenum level to investigate the affect of offsetting molybdenum for tungsten.

Figure 7:
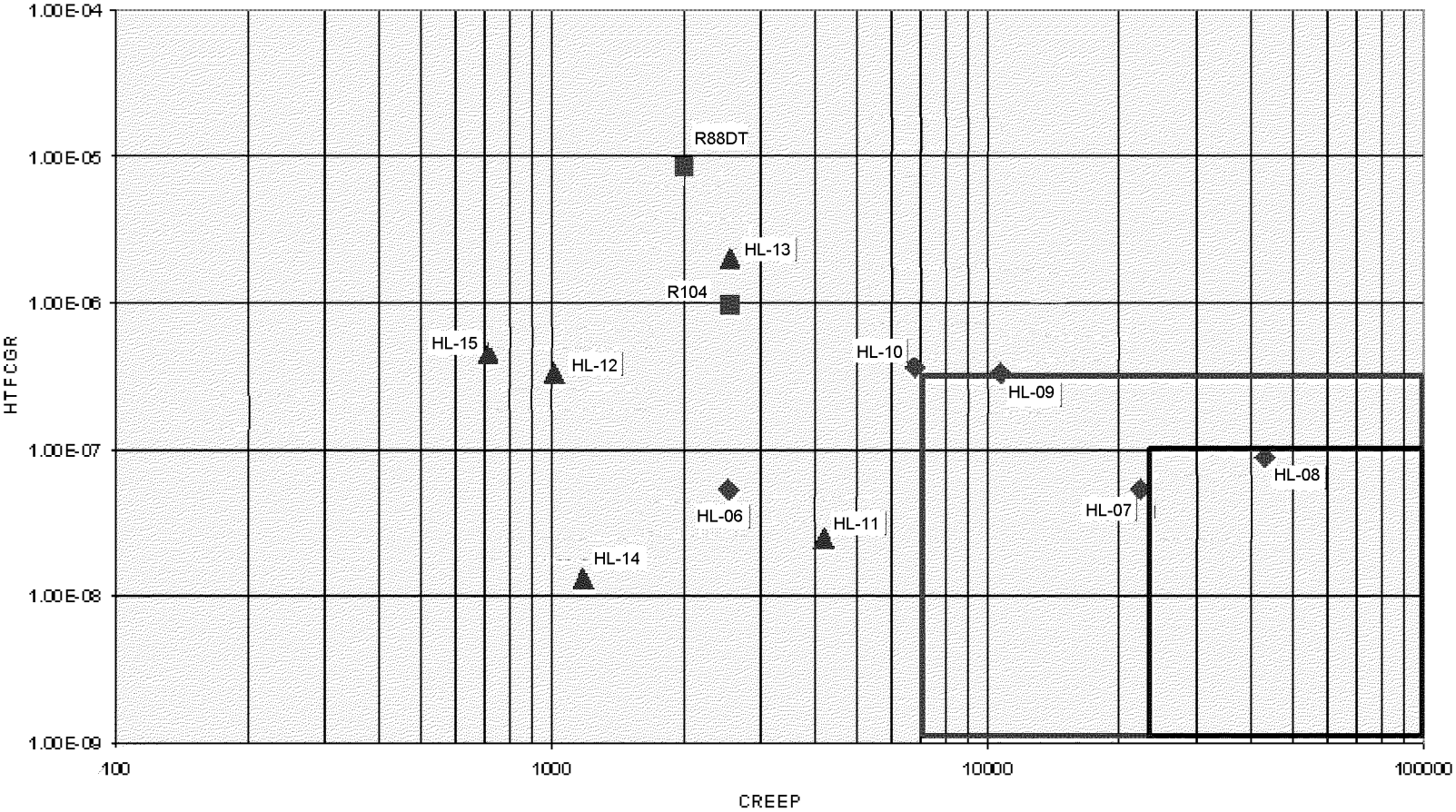
FIG. 7 is a graph plotting creep and hold time fatigue crack growth rate from the data of FIG. 6.

Regression-based property predictions for the second series of alloys are summarized in the table of FIG. 6, and FIG. 7 contains a graph of the HTFCGR and creep data from FIG. 6. From the visual depiction of FIG. 7, it can be seen that alloys HL-07, HL-08 and HL-09 were analytically predicted to exhibit the best combinations of creep and hold time crack growth rate characteristics, with creep exceeding 7000 hours and HTFCGR of about $3\times10^{7}$ in/s (about $7.6\times10^{6}$ mm/s) or less, and therefore offering a notable improvement of the regression-based predictions for R88DT, R104, and other current alloys plotted in FIG. 7. The alloys were also assessed for alloy characteristics such as phase volume fraction, stability and solvii, and none were predicted to have potentially undesirable levels of formation of TCP phases.

Figure 10:
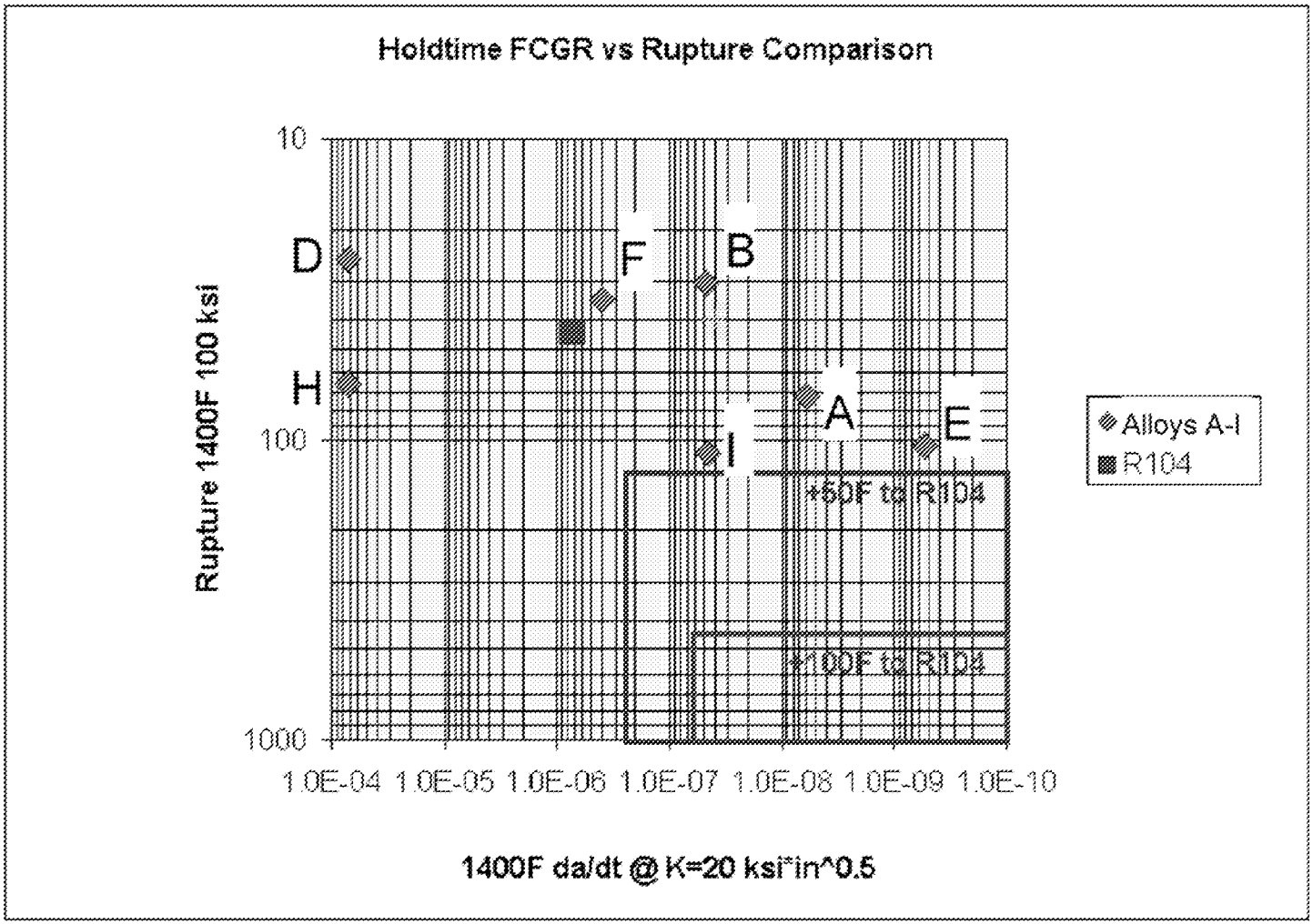
FIG. 10 is a graph plotting rupture data versus HTFCGR data for the nickel-base superalloy compositions of FIG. 8.

On the basis of the above predictions, nine alloys (Alloys A through I) were prepared with compositions based on the ten alloys of the second series. The actual chemistries (in weight percent) of the prepared alloys are summarized in the table of FIG. 8. From these alloys, two distinguishable alloy types were identified based in part on their different tantalum and molybdenum contents. The first alloy type, encompassing Alloys A through H, is summarized in Table II below and characterized in part by relatively high tantalum levels. The second alloy type, encompassing Alloy I, is summarized in Table III below and characterized by a relatively high molybdenum content. Also summarized in Table II are alloying ranges for the compositions of Alloys A and E, which are believed to have particularly promising properties based on actual performance in a HTFCGR (da/dt) test conducted at about 1400° F. and using a three hundred second hold time (dwell) and a maximum stress intensity of 20 ksi√m (about 22 MPa√m). The crack growth rates of Alloys A through I and their crack growth rates relative to RI 04 are summarized in Table I below. A table provided in FIG. 9 summarizes other properties of Alloys A through I relative to R104. Ultimate tensile strength (UTS) yield strength, (0.02% YS and 0.2% YS), elongation (EL), and reduction of area (RA) were evaluated at 1400° F. (about 760° C.), while time to 0.2% creep (0.2% CREEP) and rupture (RUPTURE TIME) were evaluated at 1400° F. and 100 ksi (about 760° C. at about 690 MPa). It should be noted that the creep and rupture behavior of Alloys A, E and I were significantly higher than those of R104, which itself is considered to exhibit very good creep and rupture behavior. FIG. 10 provides a graph plotting the rupture data of FIG. 9 versus the HTFCGR data of Table I. From the visual depiction of FIG. 10, it can be seen that alloys A, E and I exhibited the best combinations of hold time crack growth rate and rupture, and indicate a notable improvement over R104.

TABLE I

| Alloy | in/sec | Relative crack growth rate |
|---|---|---|
| A | $6.09\times10^{-9}$ | 0.008 |
| B | $4.83\times10^{-8}$ | 0.067 |
| C | $1.90\times10^{-7}$ | 0.263 |
| D | $7.02\times10^{-5}$ | 97.1 |
| E | $5.43\times10^{-10}$ | 0.001 |
| F | $3.92\times10^{-7}$ | 0.543 |
| G | $1.88\times10^{-7}$ | 0.260 |
| H | $7.02\times10^{-5}$ | 97.1 |
| I | $4.63\times10^{-8}$ | 0.064 |
| R104 | $7.23\times10^{-7}$ | 1 |

The titanium:aluminum weight ratio is believed to be important for the alloys of Tables II and III on the basis that higher titanium levels are generally beneficial for most mechanical properties, though higher aluminum levels promote alloy stability necessary for use at high temperatures. In addition, the molybdenum:molybdenum+tungsten weight ratio is also believed to be important for the alloys of Table II as this ratio indicates the refractory content for high temperature response and balances the refractory content of the gamma and the gamma prime phases. As such, these ratios are also included in Tables II and III where applicable. In addition to the elements listed in Tables II and III, it is believed that minor amounts of other alloying constituents could be present without resulting in undesirable properties. Such constituents and their amounts (by weight) include up to 2.5% rhenium, up to 2% vanadium, up to 2% iron, and up to 0.1% magnesium.

TABLE II

| Element | Broad | Narrower | Preferred | Alloy A | Alloy E |
|---|---|---|---|---|---|
| Co | 16.0-30.0 | 17.1-20.9 | 17.1-20.7 | 18.8-20.7 | 17.1-18.9 |
| Cr | 11.5-15.0 | 11.5-14.3 | 11.5-13.9 | 12.6-13.9 | 11.5-12.7 |
| Ta | 4.0-6.0 | 4.4-5.6 | 4.5-5.6 | 4.5-5.5 | 4.6-5.6 |
| Al | 2.0-4.0 | 2.1-3.7 | 2.1-3.5 | 2.1-2.6 | 2.9-3.5 |
| Ti | 1.5 to 6.0 | 1.7-5.0 | 2.8-4.0 | 3.1-3.8 | 2.8-3.4 |
| W | up to 5.0 | 1.0-5.0 | 1.3-3.1 | 1.3-1.6 | 2.5-3.1 |
| Mo | 1.0-7.0 | 1.3-4.9 | 2.6-4.9 | 4.0-4.9 | 2.6-3.2 |
| Nb | up to 3.5 | 0.9-2.5 | 0.9-2.0 | 0.9-1.1 | 1.3-1.6 |
| Hf | up to 1.0 | up to 0.6 | 0.1-0.59 | 0.13-0.38 | 0.20-0.59 |
| C | 0.02-0.20 | 0.02-0.10 | 0.03-0.10 | 0.03-0.10 | 0.03-0.08 |
| B | 0.01-0.05 | 0.01-0.05 | 0.01-0.05 | 0.02-0.05 | 0.01-0.04 |
| Zr | 0.02-0.10 | 0.02-0.08 | 0.02-0.08 | 0.02-0.07 | 0.03-0.08 |
| Ni | Balance | Balance | Balance | Balance | Balance |
| Ti/Al | 0.5-2.0 | 0.54-1.83 | 0.98-1.45 | 1.18-1.45 | 0.98-1.18 |
| Mo/ (Mo + W) | 0.24-0.76 | 0.24-0.76 | 0.51-0.76 | 0.71-0.76 | 0.51-0.56 |

TABLE III

| Element | Broad | Narrower | Preferred |
|---|---|---|---|
| Co | 18.0-30.0 | 18.0-22.0 | 18.0-22.0 |
| Cr | 11.4-16.0 | 11.5-16.0 | 11.4-14.0 |
| Ta | up to 6.0 | up to 4.0 | 3.3-4.0 |
| Al | 2.5-3.5 | 2.5-3.5 | 2.8-3.4 |
| Ti | 2.5 to 4.0 | 2.5-4.0 | 3.0-3.6 |
| W | 0.0 | 0.0 | 0.0 |
| Mo | 5.5-7.5 | 5.5-7.5 | 5.8-7.1 |
| Nb | up to 2.0 | up to 2.0 | 1.0-1.2 |
| Hf | up to 2.0 | up to 2.0 | 0.30-0.49 |
| C | 0.04-0.20 | 0.04-0.20 | 0.04-0.11 |
| B | 0.01-0.05 | 0.01-0.05 | 0.01-0.04 |
| Zr | 0.03-0.09 | 0.03-0.09 | 0.03-0.09 |
| Ni | Balance | Balance | Balance |
| Ti/Al | 0.71-1.60 | 0.71-1.60 | 0.88-1.29 |

Though the alloy compositions identified in FIGS. 2, 5 and 8 and the alloys and alloying ranges identified in Tables II and III were initially based on analytical predictions, the extensive analysis and resources relied on to make the predictions and identify these alloy compositions provide a strong indication for the potential of these alloys, and particularly the alloy compositions of Tables II and III, to achieve significant improvements in creep and hold time fatigue crack growth rate characteristics desirable for turbine disks of gas turbine engines.

While the invention has been described in terms of particular embodiments, including particular compositions and properties of nickel-base superalloys, the scope of the invention is not so limited. Instead, the scope of the invention is to be limited only by the following claims.

The invention claimed is:

1. A gamma-prime nickel-base superalloy that has been hot-worked at a temperature at or near a recrystallization temperature of the superalloy but less than a gamma prime solvus temperature of the superalloy, the superalloy consisting of, by weight:

16.0 to 30.0% cobalt;
11.5 to 15.0% chromium;
4.0 to 6.0% tantalum;
2.0 to 4.0% aluminum;
2.0 to 3.4% titanium;
up to 5.0% tungsten;
1.0 to 7.0% molybdenum;
up to 3.5% niobium;
up to 1.0% hafnium;
0.02 to 0.20% carbon;
0.01 to 0.05% boron;
0.02 to 0.10% zirconium;
the balance essentially nickel and impurities, wherein the titanium:aluminum weight ratio is 0.5 to 1.7, wherein the superalloy contains sufficiently low levels of topologically close-packed (TCP) phases including the sigma phase and the eta phase ($Ni_3Ti$) to exhibit a time to 0.2% creep at 1200° F. and 115 ksi (about 650° C. and about 790 MPa) of at least 1200 hours.

2. The gamma-prime nickel-base superalloy according to claim 1, wherein the tantalum content is at least 4.4%.

3. The gamma-prime nickel-base superalloy according to claim 1, wherein the tantalum content is 4.4 to 5.6%.

4. The gamma-prime nickel-base superalloy according to claim 1, wherein the titanium:aluminum weight ratio is 0.54 to 1.7.

5. The gamma prime nickel-base superalloy according to claim 1, wherein the molybdenum:molybdenum+tungsten weight ratio is 0.24 to 0.76.

6. The gamma-prime nickel-base superalloy according to claim 1, wherein the hafnium content is at least 0.1%.

7. The gamma-prime nickel-base superalloy according to claim 1, wherein the gamma-prime nickel-base superalloy consists of, by weight, 17.1 to 20.9% cobalt, 11.5 to 14.3% chromium, 4.4 to 5.6% tantalum, 2.1 to 3.7% aluminum, 2.0 to 3.4% titanium, 1.0 to 5.0% tungsten, 1.3 to 4.9% molybdenum; 0.9 to 2.5% niobium, up to 0.6% hafnium, 0.02 to 0.10% carbon, 0.01 to 0.05% boron, 0.02 to 0.08% zirconium, the balance nickel and impurities, wherein the titanium:aluminum weight ratio is 0.54 to 1.7.

8. The gamma-prime nickel base superalloy according to claim 7, wherein the molybdenum:molybdenum+tungsten weight ratio is 0.24 to 0.76.

9. A component formed of the gamma-prime nickelbase superalloy of claim 1.

10. The component according to claim 9, wherein the component is a powder metallurgy component chosen from the group consisting of turbine disks and compressor disks and blisks of gas turbine engines.

11. The gamma-prime nickel-base superalloy according to claim 1, wherein the gamma-prime nickel-base superalloy consists of, by weight, 17.1 to 20.7% cobalt, 11.5 to 13.9% chromium, 4.5 to 5.6% tantalum, 2.1 to 3.5% aluminum, 2.8 to 3.4% titanium, 1.3 to 3.1% tungsten, 2.6 to 4.9% molybdenum; 0.9 to 2.0% niobium, 0.1 to 0.59% hafnium, 0.03 to 0.10% carbon, 0.01 to 0.05% boron, 0.02 to 0.08% zirconium, the balance nickel and impurities, wherein the titanium:aluminum weight ratio is 0.98 to 1.45.

12. The gamma-prime nickel-base superalloy according to claim 11, wherein the molybdenum:molybdenum+tungsten weight ratio is 0.51 to 0.76.

13. The gamma-prime nickel-base superalloy according to claim 1, wherein the gamma-prime nickel-base superalloy consists of, by weight, 18.8 to 20.7% cobalt, 12.6 to 13.9% chromium, 4.5 to 5.5% tantalum, 2.1 to 2.6% aluminum, 3.1 to 3.4% titanium, 1.3 to 1.6% tungsten, 4.0 to 4.9% molybdenum; 0.9 to 1.1% niobium, 0.13 to 0.38% hafnium, 0.03 to 0.10% carbon, 0.02 to 0.05% boron, 0.02 to 0.07% zirconium, the balance nickel and impurities, wherein the titanium:aluminum weight ratio is 1.18 to 1.45.

14. The gamma-prime nickel-base superalloy according to claim 13, wherein the molybdenum:molybdenum+tungsten weight ratio is 0.71 to 0.76.

15. A component formed of the gamma-prime nickel-base superalloy of claim 14.

16. The component according to claim 15, wherein the component is a powder metallurgy component chosen from the group consisting of turbine disks and compressor disks and blisks of gas turbine engines.

17. The gamma-prime nickel-base superalloy according to claim 1, wherein the gamma-prime nickel-base superalloy consists of, by weight, 17.1 to 18.9% cobalt, 11.5 to 12.7% chromium, 4.6 to 5.6% tantalum, 2.9 to 3.5% aluminum, 2.8 to 3.4% titanium, 2.5 to 3.1% tungsten, 2.6 to 3.2% molybdenum; 1.3 to 1.6% niobium, 0.20 to 0.59% hafnium, 0.03 to 0.08% carbon, 0.01 to 0.04% boron, 0.03 to 0.08% zirconium, the balance nickel and impurities, wherein the titanium:aluminum weight ratio is 0.98 to 1.18.

18. The gamma-prime nickel-base superalloy according to claim 17, wherein the molybdenum:molybdenum+tungsten weight ratio is 0.51 to 0.56.

19. A component formed of the gamma-prime nickel-base superalloy of claim 17.

20. The component according to claim 19, wherein the component is a powder metallurgy component chosen from the group consisting of turbine disks and compressor disks and blisks of gas turbine engines.

21. The gamma-prime nickel-base superalloy according to claim 1, wherein the gamma-prime nickel-base superalloy has a gamma prime solvus temperature of not more than 1200° C.

* * * * *